US005836653A

United States Patent [19]

Albecker

[11] Patent Number: 5,836,653

[45] Date of Patent: Nov. 17, 1998

[54] BACKRESTS/LEGLESS LEISURE CHAIRS MADE WITH A FOUNDATION

[76] Inventor: Walter J. Albecker, 838 S. May, Chicago, Ill. 60607

[21] Appl. No.: 492,170

[22] Filed: Jun. 19, 1995

Related U.S. Application Data

[63] Continuation-in-part of Ser. No. 899,750, Jun. 17, 1992, Pat. No. 5,425,567, and Ser. No. 721,179, Jun. 26, 1991, abandoned.

[51] Int. Cl.[6] ..... A47C 20/00

[52] U.S. Cl. ..... 297/452.31; 297/452.16; 297/452.32; 5/632; 5/633

[58] Field of Search ..... 297/452.1, 452.16, 297/452.31, 452.32; 5/630, 632, 633, 653

[56] References Cited

U.S. PATENT DOCUMENTS

| | | | |
|---|---|---|---|
| D. 167,666 | 9/1952 | Argento | 5/633 X |
| 2,281,629 | 5/1942 | Snow | 297/456.17 X |
| 3,009,172 | 11/1961 | Eidam | 5/632 |
| 3,555,502 | 1/1971 | Radford | 5/632 |
| 3,680,917 | 8/1972 | Harris | 5/633 X |
| 4,171,549 | 10/1979 | Morrell et al. | 5/632 |
| 4,627,423 | 12/1986 | Kampner | 5/633 X |
| 4,635,306 | 1/1987 | Willey | 5/632 |
| 5,432,967 | 7/1995 | Raftery | 5/633 |

FOREIGN PATENT DOCUMENTS

| | | | |
|---|---|---|---|
| 1023403 | 12/1977 | Canada | 5/633 |

*Primary Examiner*—Peter R. Brown

[57] ABSTRACT

A number of generally wedge shaped backrests and legless leisure chairs for sitting on the floor or on a bed, which orient the user's upper back at a higher angle than the user's lower back. These are ideally suited for people who want to be in a reclining type position, but yet want to do something like watch television. The backrests/leisure chairs disclosed use a support foundation (42 and 46). The backrests/leisure chairs described also have a way of maintaining the lumbar region of the user's back in a relatively natural lordotic curve, some through a high firmness lumbar support member (28) on the support foundation (42 and 46) placed in a hollow in the back of the main cushion (26), and others through making a convex contour on the lower portion of the backrest/leisure chair. All of the leisure chairs for sitting on the floor have a seat cushion (34) to prevent the user from slipping down out of place and these chairs can also have a pillow (32) for a headrest. Also disclosed are a number of seat cushion and legrest alternatives (34) for the leisure chairs including folding seat cushions and a two piece seat and legrest cushion system.

21 Claims, 13 Drawing Sheets

BACKRESTS/LEGLESS LEISURE CHAIRS MADE WITH A FOUNDATION

CROSS REFERENCE TO RELATED APPLICATION

This invention is a continuation-in-part and includes elements described in application Ser. No. 07/899,750, filed Jun. 17, 1992, now U.S. Pat. No. 5,425,567, granted Jun. 20, 1995, entitled: BACKRESTS/LEGLESS LEISURE CHAIRS AND METHODS FOR MAKING CUSHIONS, and also application Ser. No. 07/721,179, filed Jun. 26, 1991 later abandoned and continued as application Ser. No. 08/197,223, filed Feb. 16, 1994, now U.S. Pat. No. 5,474,362, granted Dec. 12, 1995. Both of these patents are incorporated by reference herein, in their entirety.

BACKGROUND

1. Field of the Invention

This invention relates to furniture, and specifically to legless leisure chairs or backrests that are appropriate for use on a floor or on a bed.

BACKGROUND

2. Discussion of Prior Art

For years, people have appreciated chairs and backrests which enable them to be in a position which is somewhere between sitting up straight and lying down. There are now many types of reclining chairs and lounges on the market. Most of these are large and expensive, and also cannot be used for sitting on the floor or on a bed. Many people, including the present inventor enjoy reclining on a bed, or close to the floor. To satisfy this need, a number of inventions have been developed.

U.S. Pat. No. 2,593,319 to Levitin et al discloses a foldable furniture unit for reclining on the floor. Levitin's invention is interesting, but the portion of the back support for the lower back is concave which would tend to be uncomfortable for most people—because it works against a natural lordotic curve. Also, it requires a fair amount of floor space when used as a recliner, making it necessary for many people to fold it up after each use.

U.S. Pat. No. Design 167,666 to Argento discloses a "televiewing floor rest" which is in a generally wedge shape. Though no description of the internal construction of the chair is given, there is nothing to indicate that there is a provision for substantial lumbar support. Additionally, when the chair is in the reclined position, the viewer would probably be looking at the ceiling.

The combined ottoman and collapsible backrest in U.S. Pat. No. 2,966,205 to Blaschko lacks a specific lumbar support, is not suitable for use on a bed, similar to the Ezekoye support in reclining position mentioned below, it does not orient the user's upper back and head to comfortably view a television placed at a normal height, does not seem to provide an effective means to keep the user from slipping down, takes up a lot of floor space when in the backrest position, which may necessitate folding and unfolding for each use, and has the limitations of a backrest that is combined with an ottoman.

The therapeutic device disclosed in U.S. Pat. No. 3,555,582 to Radford provides a wedge with a contour to provide additional support to portions of a user's body. The therapeutic device is designed to be used in a sofa or bed, and appears to be for orienting the head, neck and upper back in a position suitable for watching television or reading. This invention does not appear to do anything for the lower back.

U.S. Pat. No. 3,995,335 to Neely discloses a backrest made of a number of pillows attached to a frame, designed to enable invalids to sit up in bed. Neely's invention is bulky and clumsy, and though it may be very functional as a pillow for invalids, it is probably not best suited as a leisure chair for general use.

U.S. Pat. No. 4,064,580 to Ezekoye shows a multi-position back support; however it does not provide a means of preventing a user from slipping down, does not provide any lumbar support, doesn't have a cushion for the user's buttocks, and in the reclining position, the user basically is looking up at the ceiling.

The cushion ensemble and method of arranging cushions disclosed in U.S. Pat. No. 4,171,549 to Morrell and Gray provide a chair or lounge. The cushion ensemble appears simple and economical to manufacture, but it does not provide a clearly articulated lumbar support, is somewhat bulky and clumsy, probably requires rearrangement after each use, would be very casual if considered furniture, and probably is not very effective at preventing the user from slipping down since the seat cushion is not attached.

Canadian Patent No. 1,023,483 to Kohn discloses a bed cushion support having a provision for a small of the back support protruding from the lower center portion as well as an angle between the upper portion and lower portion. The protrusion for the small of the back support would make the backrest difficult to upholster, and might put an undue amount of pressure on the spine of an occupant. Note that the protrusion is primarily supporting only the spine the point of the small of the back. The present invention supports the spine in the lumbar region as well as the body areas near the spine to better distribute the weight or pressure.

U.S. Pat. No. 4,410,214 to Geschwonder discloses a leisure chair which can be used in a generally upright position or in a reclining position. Although it is simple and compact, it does not provide a lumbar support, and because the back support is straight, the user has two choices, sit up straight, or recline generally facing the ceiling. There is also no headrest when the chair is in the upright position, and there is also no seat cushion when the leisure chair is used in the reclining position.

The multi-sectional backrest and pillow having the capability of assuming a series of different configurations in U.S. Pat. No. 4,970,742 to Keener does not provide a way to enable the lower back to be at a very low angle which can be very comfortable, while at the same time positioning the upper back and head in such a way that the head can watch a television comfortably when the television is at a standard height. Additionally, the backrest does not seem to provide a clearly articulated lumbar support.

Other inventions which may relate to this field include the floor rocker or video rocker sold in a number of department stores, the adjustable body positioner disclosed by Walpin in U.S. Pat. No. 4,853,993, reclining chairs like La-Z-Boy, the "Wink" chair by Kita, a lounger made by Vuokko designed by Antti Nurmesniemi from Finland, a variety of other chairs which sit close to the ground, and a variety of cushioned backrests for use in bed commonly seen in department stores.

All of the backrests/legless leisure chairs heretofore known to the present inventor suffer from one or more of the following disadvantages:

(a) They do not provide a way for the user's lower back to be very comfortable and relaxed at a low angle, while the user's shoulders and head are at an angle that can be comfortable and well suited for reading and watching television.

(b) A specific lumbar support is not provided for greater comfort and to maintain the natural lumbar lordotic curve.

(c) The design is not suited for use as a regular piece of furniture in a home, such as in a recreation room.

(d) The design is relatively expensive to produce.

(e) The design is not compact and/or relatively portable.

(f) The design does not provide for use in a reclined as well as a more upright position.

(g) The design does not provide an effective means for preventing a person from slipping down, out of the preferred position.

(h) The design does not provide for a good portion of the user's weight to be distributed over a fairly large portion of the chair, instead of being concentrated at the seat.

(i) The design does not provide for a seat cushion that substantially cushions the users buttocks, helps prevent the user from slipping down, and can also be used to enable the user to easily change position from leaning against the backrest to sitting upright without leaning against it.

OBJECTS AND ADVANTAGES OF INVENTION

Accordingly, several objects and advantages of the present invention are:

(a) To provide leisure chairs/backrests that enable the user's lower back to be at a low angle which can be very relaxing and comfortable, while at the same time positioning the user's upper back and head in a way that is suitable for reading or for watching television when the television is at a standard height.

(b) To provide leisure chairs/backrests that give good support for the user's lower back, especially the lumbar region. Good lumbar support is especially important in reclining type leisure chairs/backrests, because gravity tends to flatten the natural lordotic curve of the lumbar region in the users back.

(c) To provide leisure chairs/backrests that are attractive, appropriate for use as a regular piece of furniture in a home, and can be made to suit a variety of tastes, largely depending on the upholstery fabric chosen. And the design can be adapted for use in a living room, recreation room, or for outdoor use.

(d) To provide leisure chairs/backrests that can be relatively simple and inexpensive to manufacture.

(e) To provide leisure chairs/backrests that provide efficient use of space. Many chairs, such as the Chaise Lounges which provide some of the same benefits as this chair take up a lot of floor space in a home—especially when not in use.

(f) To provide leisure chairs/backrests that could be made fixed or dual position to suit a number of people for a number of purposes. This could enable users to be in either a reclining position, or a more upright position. Such a feature would provide for greater individual comfort and usefulness.

(g) To provide backrests that can be used on a bed or a sofa.

(h) To provide legless leisure chairs that can be used on the floor. Many people enjoy sitting close to the floor. There are a number of other countries where sitting close to the floor is the main way people sit in homes. In America, many people enjoy sitting close to the floor for reading, to be in front of a fireplace, or while watching television. Since most televisions are only a couple feet above the floor level, this provides leisure chairs near the floor with a line of sight advantage over traditional height chairs, enabling people to look at television at about eye level instead of looking down on the television. This enables the user to recline further while still being able to see the television.

(i) To provide leisure chairs/backrests that are substantial, secure, and well made.

(j) To provide leisure chairs/backrests that will tend to keep the user in the right position, by preventing the user from slipping down to a less than desirable position.

(k) To provide leisure chairs/backrests that distribute the user's weight to the backrest as well as to the seat area, for greater comfort.

(l) To provide leisure chairs/backrests that can be used with an adapted work surface to be useful for doing work on a computer or desk top surface while in a reclined position.

(m) To provide leisure chairs/backrests that are ideal for people who are tired at the end of the day.

(n) To provide backrests for beds and sofas that enable the user to get comfortable in a way that is simple and convenient, instead of having to move a number of pillows and/or cushions around in an awkward way that often gives unsatisfactory results.

(o) To provide leisure chairs with a seat cushion that cushions the user's buttocks, helps prevent the user from slipping down, and is appropriate for sitting up in a regular floor sitting position. The latter will enable a user to change from the position of leaning against the backrest to an upright sitting position without leaning against the backrest. Since it is usually uncomfortable to sit in one position for a long time, this makes it possible and convenient to change positions when desired.

Further objects and advantages of my invention will become apparent from a consideration of drawings and ensuing descriptions of it.

BRIEF DESCRIPTION OF THE DRAWINGS

In the drawings, closely related figures have the same number, but different alphabetic suffixes.

DESCRIPTION OF INVENTION

Figure 1A:
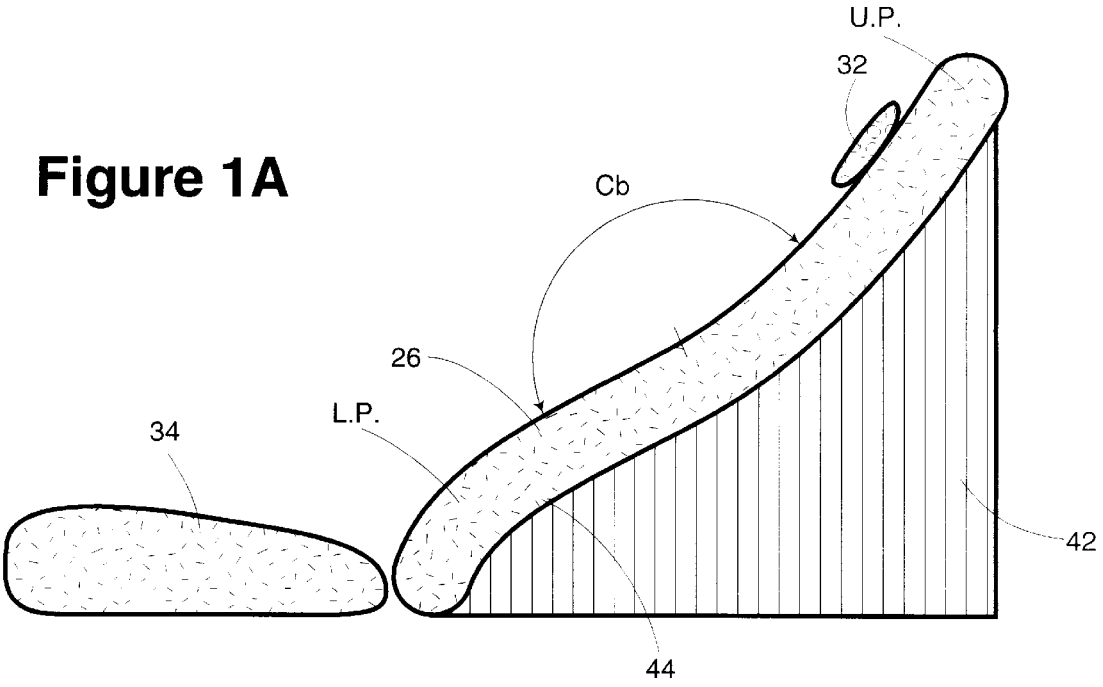
FIG. 1A a side view of an embodiment of the present invention having a contoured top cushion and foundation to provide a lumbar support.

FIG. 1A is a side view of an embodiment of the present invention having a contoured top cushion 26 and foundation 42 for providing a lumbar support. In the drawing, 42 is a foundation made of a flexible foam material such as polyurethane foam having an ILD (Indentation Load Deflection on 4" at 25%) of at least 30 pounds, or of a more rigid material such as styrofoam or other type of material that can make such a shape as shown. The foundation 42 is in a generally wedge shape and has a flat bottom, flat sides, and a flat back, but the sloped face has a convex contour 44 on the lower portion L.P.—which extends substantially from side to side. Note: If the foundation is made of rigid materials such as styrofoam, plywood, particle board, etc., the bottom, back, or even the sides could be made generally open and the inside could be substantially hollow. The purpose of the convex curve 44 is to support the lumbar region of the user's back in a relatively natural lordotic curve. The lordotic curve is a normal curve in a human's lower back. Lumbar refers to the region of the spine where the lordotic curve is.

The convex curve 44 is shaped to roughly mirror a lordotic curve. As approximately shown in FIGS. 1A and 1C, the convex curve 44 is roughly in the shape of a thin half teardrop. The curve 44 is somewhat sharper toward the bottom, and flatter as it goes up. The apex of the convex curve 44 would be about 4" to about 8" from the bottom of the slope of the foundation. Looking at the straight line from the bottom of the slope of the foundation 42 to an approximate mid point on the slope of the foundation 42 shown in FIG. 1C, the position of the highest point above this line would be about 4" to 8" from the bottom of the slope of the foundation 42. Variables that will affect this are the thickness and firmness of the seat cushion 34, thickness of the top cushion 26, and degree of pitch or incline on the lower portion of the sloped face of the foundation—the higher the incline, the higher the apex will be positioned on the slope (Note: The height of the position of the apex on the slope is different from the actual height of the apex.). Also, the shape of the convex curve 44 on the lower portion L.P. would be determined by the firmness of the foundation and the thickness and firmness of the top cushion 26. It is probably advantageous for a chair with a foundation 42 that has an ILD of about 50 to have a flatter or less pronounced convex curve 44 (an apex of about 2" would probably be appropriate) than a chair with a foundation 42 that has an ILD of about 30 (an apex of about 3" might be preferred). The curve shown in the drawing might be better suited for a foundation 42 having an ILD closer to 30. It should be pointed out that the dimensions and characteristics of the convex curve lumbar support 44 and the top cushion 26 can vary to meet comfort requirements, aesthetic considerations, or economic constraints.

The foundation also has a generally concave curve or obtuse angle bend Cb above the convex curve 44 resulting in the average general incline or pitch of the lower portion L.P. of the slope to be at a lower angle relative to a horizontal plane (such as a floor) than the average general incline or pitch of the upper portion U.P. The average general incline or pitch refers to the average of the preponderate direction of the incline, and does not take into account any major deviations from the preponderate incline or pitch, such as may be near the ends of the lower portion L.P. or upper portion L.P. This is to enable an occupant to sit on the chair with his or her lower back at a comfortable lower angle while his or her upper back and head are oriented at a higher angle for watching television or some other sitting activity.

The claims define the convex contour 44 as a generally convex semi-elliptically shaped elongated cylindrical firm lumbar support support on the lower portion of the relatively firm foundation and extending substantially to a lower edge of said face. It is appropriate to view the rudimentary foundation as a generally wedge shape that has a generally concave curve between its lower portion and its upper portion, and where the lower portion is generally flat as shown in FIG. 2A as 42. On this generally flat lower portion is a convex lumbar support 44. This convex lumbar support can be integral and continuous with the foundation, or can be secured to the top of the lower portion of the foundation as might be the case if the foundation was made of a rigid material such as plywood, particle board etc. With regards to all of the FIGS. 1–4 which show a foundation, to go from the rudimentary foundation defined above to the ones having a convex lumbar support as shown requires the addition of a generally convex semi-elliptically shaped elongated cylindrical firm lumbar support support on the lower portion of the relatively firm foundation. This addition whether integral and continuous or not, converts the rudimentary foundations to foundations having a convex contour on their lower portion. Though the lumbar support is defined as elongated, this should not be construed limit the design from obvious variations described in the incorporated by reference U.S. Pat. No. 5,474,362.

On top of the foundation 42 is a top cushion 26 which is made of a material such as polyurethane foam and has an ILD of about 40 pounds or less. In a preferred embodiment, the top cushion has an ILD of about 20 to 30 pounds and the foundation has an ILD of about 40 to 50 pounds, but the foundation and top cushions can certainly be made with other combinations or variations, and as will be seen in FIG. 1E, can be made of the same material. The top cushion 26 can be attached to the foundation 42 with an adhesive or with mechanical type fasteners such as buttons that might be used with the upholstery that is selected.

In a preferred embodiment, the top cushion 26 has a length of about 36 inches, is between about 2" to 4" thick, and is about 24" wide. The top cushion 26 can be made flat and then when it is attached to the foundation 42 it would follow the contours of the foundation 42, or it can be made or cut in the in the shape of the top of the foundation 42 with all the contours.

An optional head pillow 32 is shown, and can be attached with straps or another attachment means, or the head pillow can be left loose and not attached. Note that the head pillow 32 can be used behind an occupant's neck or behind an occupant's head—as desired. The head pillow 32 in a preferred embodiment is filled with a softer material than the top cushion 26. The filling could be a loose filling such as feathers, shredded polyurethane foam, dacron, etc., or could be a very soft polyurethane foam material, preferably with an ILD (Indentation Load Deflection on 4" at 25%) of about 12 pounds. The straps or other attachment means for the head pillow would be attached either directly to the foundation 42 or to upholstery that goes on either the top cushion 26 or on the foundation 42. In a preferred embodiment, the straps are made so that the position of the pillow can be adjusted to suit personal preferences. Though a preferred embodiment uses straps for the head pillow, these straps are not essential to the head pillow working properly, but it makes things a little more convenient. Also, though a soft material for the head pillow 32 is suggested, it is understood that personal preferences vary, and that some people prefer a firm pillow.

Additionally a seat cushion 34 is shown for supporting the buttocks and at least part of an occupant's legs. In a preferred embodiment, the seat cushion 34 is filled with a firmer material than the top cushion 26. The reason for this is that in addition to preventing the user from sliding down, a lot of the user's weight is concentrated on the seat cushion 34. The seat cushion 34 can be filled with loose fill such as feathers, shredded polyurethane foam, dacron, etc., or could be a relatively firm polyurethane foam material, preferably with an ILD (Indentation Load Deflection on 4" at 25%) of about 40 pounds. If a loose fill material is used, it can be packed much more tightly than for the head pillow 32 mentioned above. The seat cushion 34 can be made with a material about as firm as the top cushion 26, but if it is, it probably should be thicker. It is also possible to make the seat cushion 34 in layers, with the bottom layer(s) of firmer material and the top layer(s) of a softer material. In general, the seat cushion 34 should be more supportive than the top cushion 26 (an exception might be if the top cushion 26 is made of an extra firm material with an ILD greater than 40 pounds or if it was made more than 5" thick).

The general dimensions of a presently preferred embodiment are as follows: the foundation 42 base is approximately 20" to approximately 22" wide (measured from side to side) and approximately 22" to approximately 24" from front to back, the foundation back is approximately 20" to approximately 22" wide (measured from side to side) and approximately 22" to approximately 24" from the base to the top, the main cushion 26 is approximately 24" wide (measured from side to side), approximately 4" thick, and approximately 36" long. The seat cushion is about 24" wide (measured from side to side), 5" thick (at highest point), and between approximately 12" and approximately 20" from front to back. The head pillow is about 14" to about 18" from side to side, about 6" to about 10" from top to bottom, and about 2" thick. All components are in approximately the shapes shown in the figures. Note: There can be a great variance in dimensions and shapes due to particular heights of users, preferences of users, to meet certain design or aesthetic desires, to adjust the angle of the face of the foundation 42 for different levels of relaxation or alertness, for economic or manufacturing reasons, or for other reasons. Having stated this, it is certainly possible for someone skilled in the art to make a satisfactory working model with the dimensions given and the shapes shown in the FIGS.

The foundation 42, top cushion 26, seat cushion 34, and head pillow 32 can be made out of blocks of polyurethane foam, and cut to size and shape with band saws or other cutting tools used in the art related to foam fabricating. Various additional methods of manufacturing are also described under FIGS. 2A–2F and may be used for this embodiment.

Figure 1B:
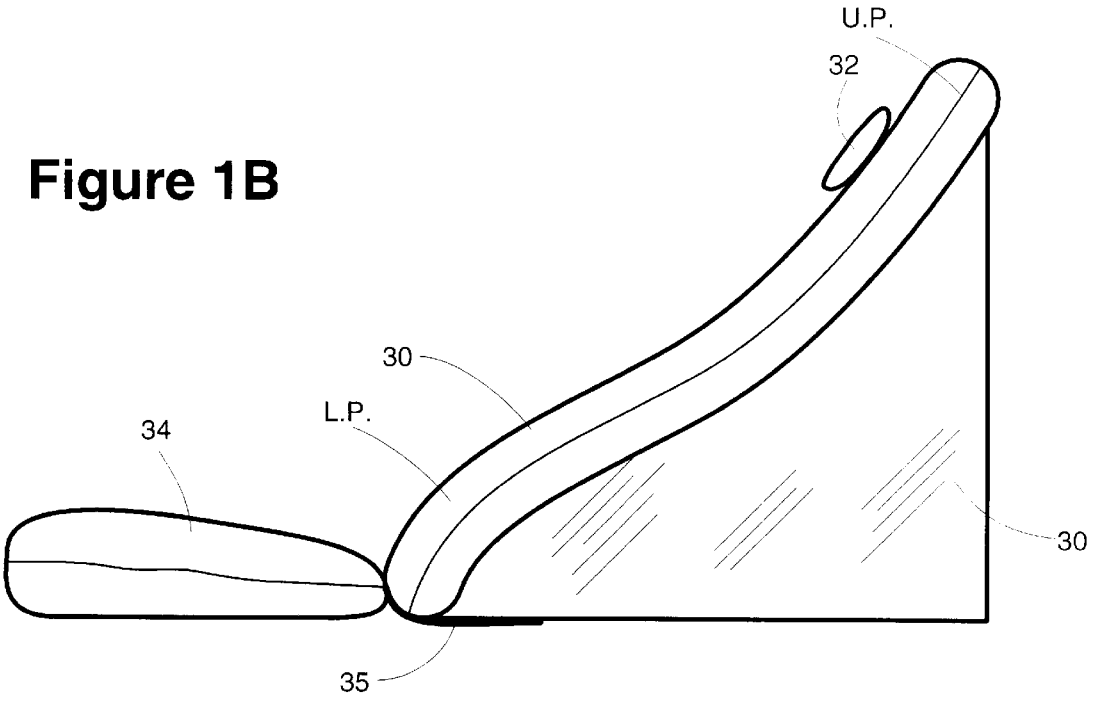
FIG 1B s a side view of the embodiment shown in FIG. 1A, but shown with upholstery.
Figure 2A:
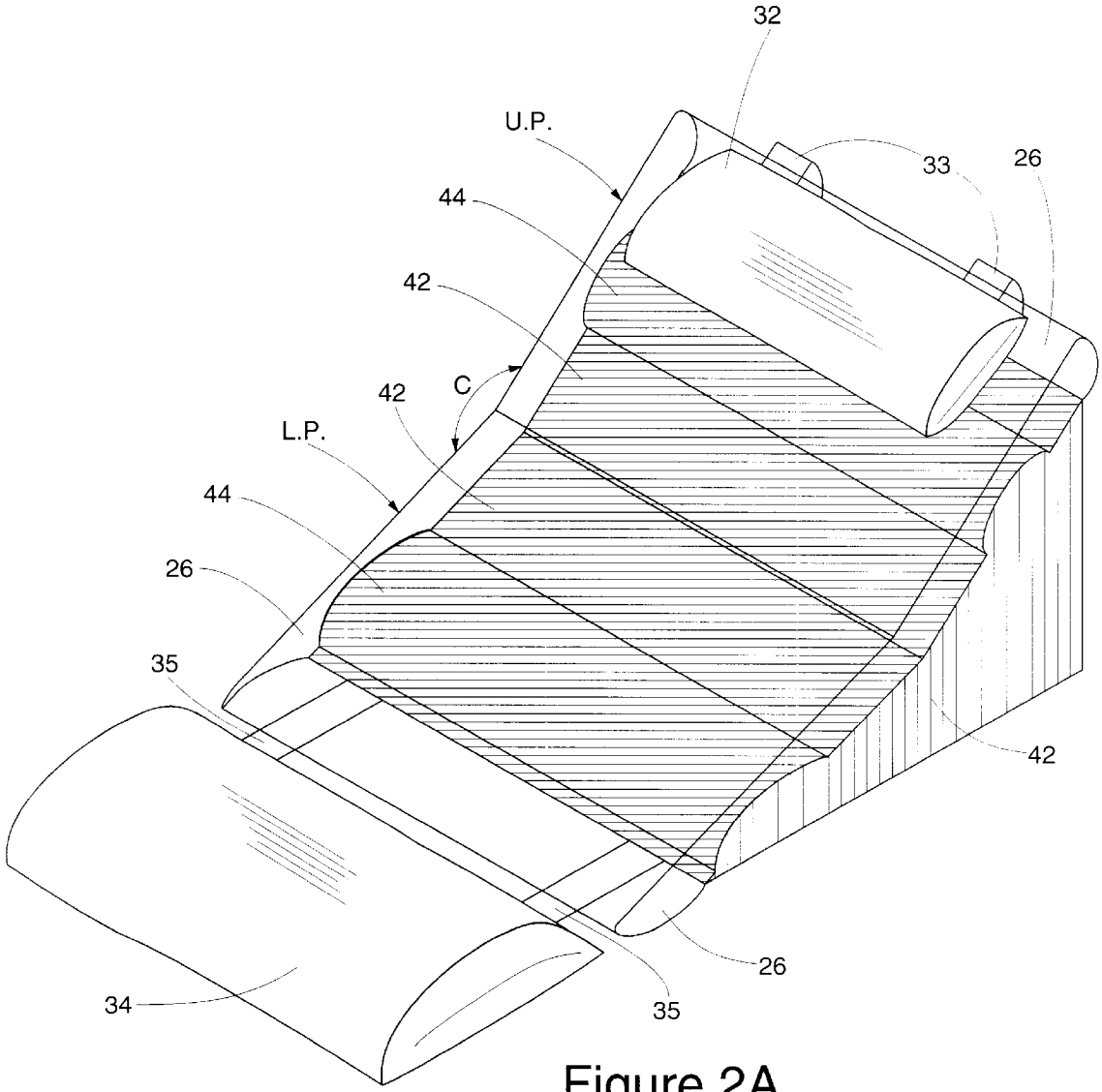
FIG. 2A is an isometric view of an embodiment of the present invention hang generally flat surfaces on the upper and lower portions of the top cushion, and using a support foundation made of a high firmness polyurethane foam, a styrofoam or a similar material. In this view, the main cushion is shown clear to show the support foundation.

FIG. 1B is a side view of the embodiment shown in FIG. 1A, but shown with upholstery 30. Note that the seat cushion 34 is attached to the foundation 42 or the upholstery 30 on the foundation with an upholstery attachment means 35. Unlike the head pillow straps mentioned above, this upholstery attachment means 35 or a similar means of securing the seat cushion 34 to the foundation 42 are essential to the proper working of the of this embodiment. The reason is that when a person is sitting on the leisure chair, there is a natural tendency to slide down caused by gravity. The seat cushion 34 is designed to prevent the user from sliding down, and needs to be secured so that the user won't slide down and move the seat cushion 34 while he or she slides down. It is not necessary that the seat cushion 34 be secured directly to the foundation 42, because if it is secured to the upholstery 30 or something else which is secured to the foundation 42, it will be indirectly secured to the foundation 42. In a preferred embodiment, the upholstery attachment means 35 could be upholstery material 30 from both the seat cushion 34 as well as the top cushion 26 joined together. I would compare this to the way the top of a typical bag of potato chips is sealed—with material from the front and back of the packaging being joined together and extending beyond the fillable portion of the package leaving a flap. In a similar manner, the seat cushion 34 could be put into upholstery material 30 that has been sewn together somewhat like a pillowcase or an open bag. After filling the upholstery 30 with the seat cushion 34, the open portion could be stitched closed, but in a manner that leaves the flap shown as the attachment means 35. This flap could then be attached to the foundation 42 or to upholstery 30 under the foundation with velcro, stitching, or possibly mechanical fasteners. The same type of technique could be used to close the bottom of the upholstery 30 on the top cushion 26—though it is not necessary that both the seat cushion 34 and top cushion 26 be secured together in this manner. Other methods that would be suitable for attaching the seat cushion 34 to the foundation 42 or upholstery 30 such as straps etc. are known in the art related to upholstery.

Figure 1C:
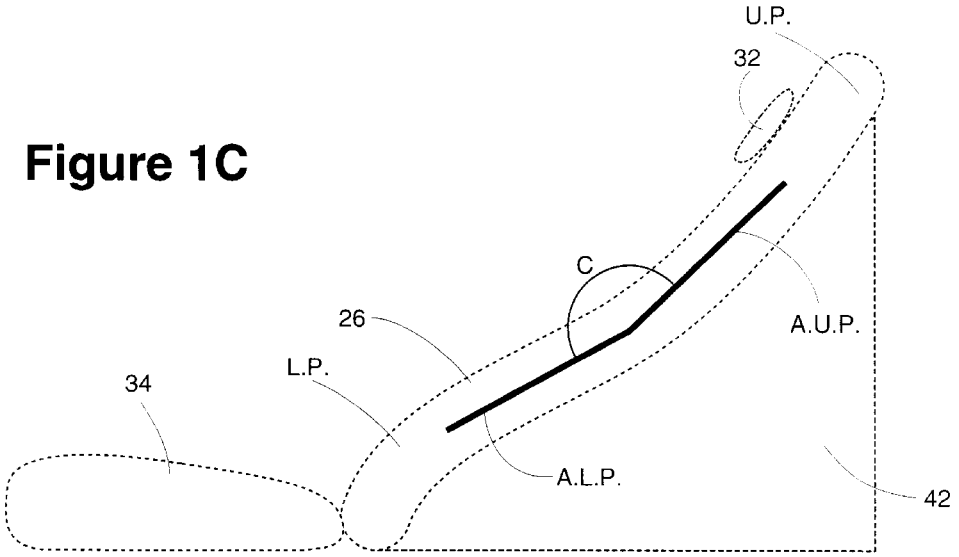
FIG. 1C is a side view of the embodiment shown in FIGS. 1A and 1B, but shown in phantom lines to show how the average general pitch of the lower portion of the chair is at a lower angle relative to a horizontal plane than the upper portion.

FIG. 1C is a side view of the embodiment shown in FIGS. 1A and 1B, but shown in phantom lines to show how the average general pitch of the lower portion L.P. of the chair is at a lower angle relative to a horizontal plane than the upper portion U.P. In the drawing, there are lines showing the average general pitch of the lower portion A.L.P. and the average general pitch of the upper portion A.U.P. and showing how these average general pitches meet between the lower portion L.P. and the upper portion U.P. to form an obtuse angle C. In a preferred embodiment, the obtuse angle C is about 170 degrees, but it can be between about 160 degrees and about 179 degrees.

The lower portion L.P. is designed to support a user's back from the sacrum to a middle range of the occupant's thoracic vertebrae. The desired middle range is known as a kyphotic curve. In a preferred embodiment, the lower portion L.P. of the top cushion 26 as measured from the bottom of the top cushion 26 to the obtuse angle C is about 16" to about 18". The upper portion U.P. is designed to support the user's back from the middle range of the occupant's thoracic vertebrae to the top of the user's skull. In a preferred embodiment, the upper portion U.P. of the top cushion 26 as measured from the obtuse angle C to the highest point of the top cushion is about 18" to about 20". These measurements can vary somewhat, especially if the backrest leisure chair is designed for children or for people of heights different from fairly average U.S. heights, or for aesthetic or economic reasons.

Figure 1D:
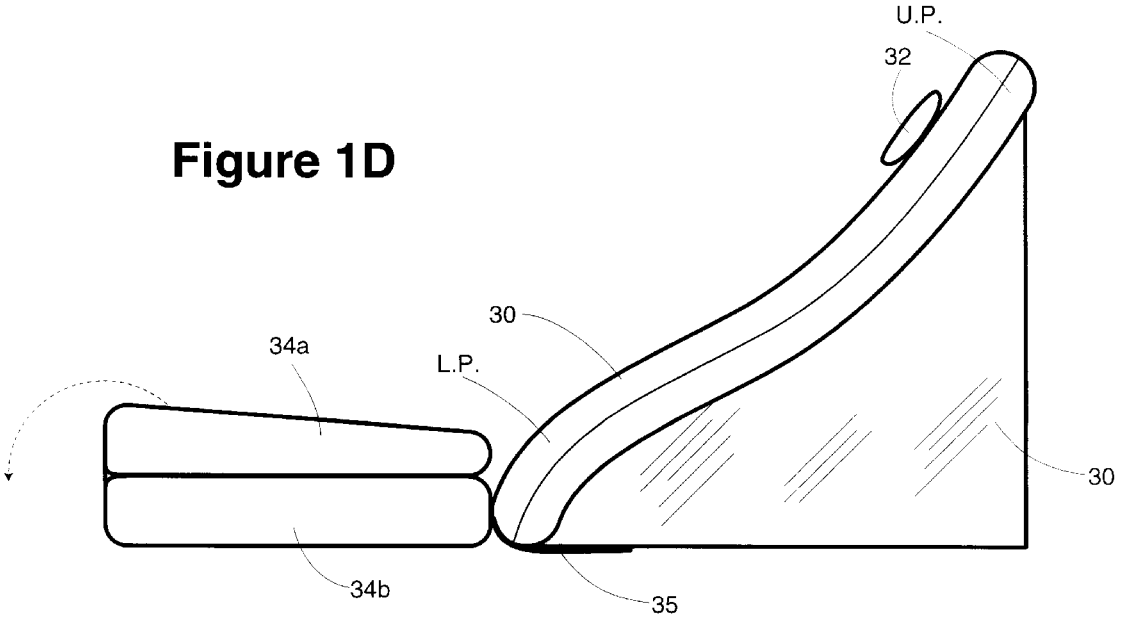
FIG. 1D is a side view of the embodiment shown in FIGS. 1A and 1B, but shown with an alternative seat cushion system.

FIG. 1D is a side view of the embodiment shown in FIGS. 1A and 1B, but shown with an alternative seat cushion system. In the drawing, the seat cushion system is shown made with two parts,—a buttocks and thigh portion 34*b* and a calf and foot portion 34*a*. Note: For clarity in the description of this drawing and all other drawings in this application, the front of the chair is shown on the left, and the rear of the chair is shown on the right. The lower cushion 34*b* is made from a generally rectangular flexible foam cushion approximately 4" high, 24" from side to side, and about 18" to 20" from front to back. The upper cushion 34*a* is made of a cushion generally similar in dimensions to the lower cushion, except that it slopes down from what is shown in the drawing as left to right. These cushions 34*a* and 34*b* can be pivotally attached like a hinge at what is shown as the front of the seat system when they are stacked. Also shown near the front is an arrow showing how the top seat cushion 34*a* can pivot if desired. The advantage of this seat system is that it enables a floor chair to be similar to a lounge in terms of completely supporting the user's legs, but at the same time it can be both stored and used in the folded position as shown. The seat system can also be made to be unfolded with the bottom cushion folding forward or being rotated in a clockwise direction as opposed to the counter-clockwise arrow shown, while the top cushion stays in position—except for moving down. Of course to do this, the top cushion 34*a* would have to be attached to the attachment means 35. A seat system similar to the one shown in FIG. 1D is shown and described under FIGS. 2E and 2F which can be consulted to aid in understanding this type of seat cushion system. And of course, the seat system could be made out of one piece instead of the two 34*a* and 34*b* as shown. In this case, the seat cushion would always be in what for the system shown would be the open or unfolded position, and for storage, could simply be folded over the pitched face of the foundation and top cushion. And for different preferences, the cushions could be reversed, with the buttocks and thigh cushion being sloped while the calf and foot cushion is generally rectangular.

Figure 1E:
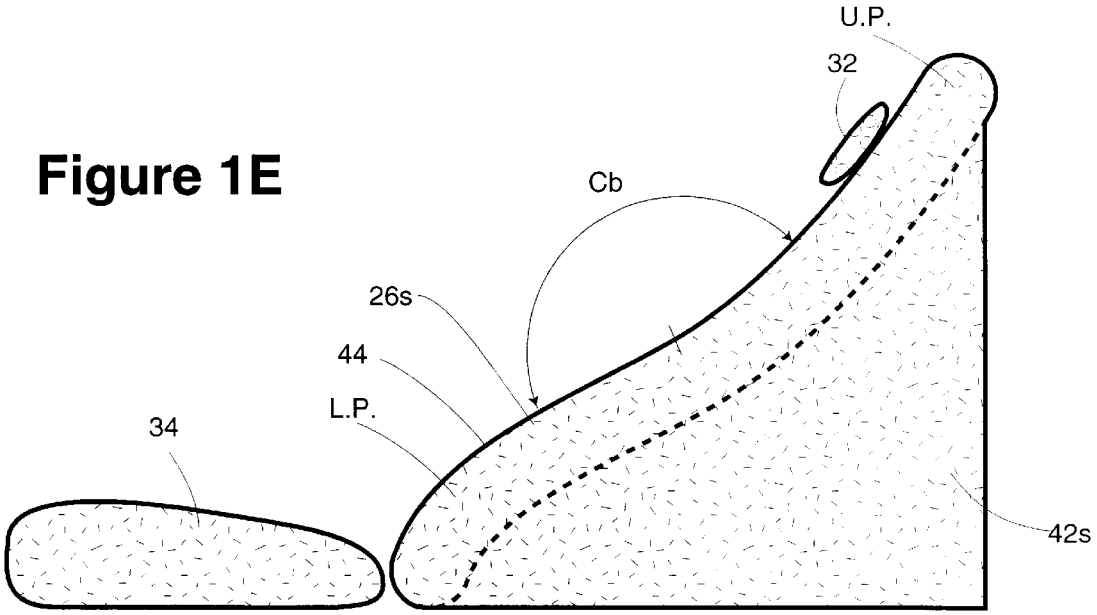
FIG. 1E is a side view of an embodiment similar to the ones shown in FIGS. 1A–1D, but shown with the foundation and top cushion made out of the same material.

FIG. 1E is a side view of an embodiment similar to the ones shown in FIGS. 1A–1D, but shown with the foundation 42*s* and top cushion 26*s* made out of the same material. In the drawing, 42*s* is a foundation that has an integral and continuous top cushion 26*s* on it or a top cushion made of the same type of material as the foundation. This could be done following principles discussed under FIG. 1A where the material is soft enough to be acceptable as a top cushion, but firm enough to support a human occupant. A polyurethane foam material with an ILD of about 35. pounds might be acceptable. As shown, the foundation 42*s* and top cushion 26*s* combination has a bend or curve as indicated by Cb that is less than 180 degrees in such a manner that the average general pitch of the slope of the upper portion U.P. is greater than the average general pitch of the lower portion L.P. For the purposes of the claims, the top 4" of material on the face of the foundation is considered to be the top cushion 26*s*, and though it may be technically the same material, it is considered as a foundation with a top cushion.

FIG. 2A is an isometric view of an embodiment of the present invention using a high firmness support foundation 42 made of styrofoam, polyurethane foam or the like. The main or top cushion 26 is shown clear in this drawing to show the support foundation 42. The support foundation 42 could be made from a variety of materials including a high firmness polyurethane foam, styrofoam, etc. which would be generally solid, or it can be made of something like fiberglass, plywood or a plastic wherein the top, sides, back and possibly the bottom are made of the material, but inside is generally hollow. In the drawing, the leisure chair is shown so it can be used in either a reclining position as shown, or in a more upright position if it were rotated 90 degrees so that what is shown as the back of the support foundation 42 would become the bottom of the support foundation, and what is shown as the bottom becomes the back. To switch positions, it would also become necessary to switch the positions of the seat cushion 34 and the head pillow 32. In doing this, the straps for the head pillow 33 become the straps for the seat cushion, and the straps for the seat cushion 35 become the straps for the head pillow. This would be accomplished by making the straps with a quick lock and release mechanism similar to those on seat belts for baby strollers. Since the backrest/leisure chair can be dual position, it is necessary to have a lumbar support for both positions. In the drawing, there are lumbar support contours 44 on the support structure of both the lower portion L.P. and on the upper portion U.P. Though not shown this way, these lumbar supports could be part of the main cushion 26, by making a hollow in the main cushion 26 of the proper size and shape, and then filling the hollow with the lumbar support—as described in my previous applications of which this is a continuation in part. Of course, when the leisure chair is put in the more upright position, the lower portion L.P. would become the upper portion U.P. and vice versa. Also in FIG. 2A, there is an obtuse angle C between the upper portion U.P. and the lower portion L.P. of about 160 degrees to about 170 degrees.

The leisure chair shown in FIG. 2A works the same way as the leisure chair shown in FIG. 1, except that instead of being for use in only one position, it is dual position. It should be pointed out that though FIG. 2A shows a leisure chair that is dual position, it is of course possible to make it for use in just one position. If the leisure chair was made for only one position, it would only need one lumbar support 44. The position chosen could be upright, reclining, or somewhere in between. In FIG. 2A the head pillow 32 is attached to straps for the head pillow 33 which are secured to the support foundation 42. The seat cushion 34 is attached to straps 35 or another suitable upholstery attachment means which would be secured either directly or indirectly to the high firmness support foundation. Though the methods of securing the straps to the support foundation will vary with the type of material the support foundation is made of, the straps must be secured well enough to the support foundation to keep the seat cushion from moving away from the support foundation when a person is sitting on it. This may require using some sort of metal anchoring system into the high firmness support foundation 42. For example, for a styrofoam support foundation 42 a metal anchor could be put in place while the foundation is being molded, so that when the styrofoam sets, the anchor would be securely attached to the styrofoam, and the anchor would be made so that a strap could be attached to it. One way of doing this would be to have a ring on the exposed portion of the anchor so that the strap could go around it. Other methods should be apparent to people knowledgeable in the art of working with materials suitable for making a high firmness support foundation.

The way of making the high firmness support foundation 42 will depend on the type of material chosen. Styrofoam, plastic, or fiberglass would probably be molded out of one piece. If the chosen material was a flexible polyurethane foam cushion with an ILD of about 50, it could be cut into shape with a band saw from a large piece of slab material. It could also be made out of plywood, with lumbar supports made of firm polyurethane foam installed to the plywood decks that form the slope of the foundation.

There are two other ways to make a high firmness support foundation and the backrest/leisure chair of this type of embodiment. Both methods involve having an internal high firmness member or members. The first method requires a mold for doing injection molding of the soft foam over the firm internal support foundation. The mold would be about the same size and shape as the foundation 42 with the soft top cushion 26 over it shown in FIG. 2B. A firm foundation of a similar size and shape as shown in FIG. 2A, except with about 1" (could be more than 1") trimmed off on the back, the bottom, and each of the two sides, would be put into the mold. This firm foundation would be held in place in the mold so that the back, the bottom, and each of the two sides would be about 1" away from the back, the bottom, and each of the two sides of the mold. The mold would be sealed closed, and a flexible foam material would be injected into the mold so that the finished product would be about the same size and shape of the foundation 42 with the soft top cushion 26 over it shown in FIG. 2B. The result would be a molded one piece generally wedge shaped foundation with soft top cushion which also has the bottom, the back, and each of the two sides cushioned with the soft cushion material.

Figure 2B:
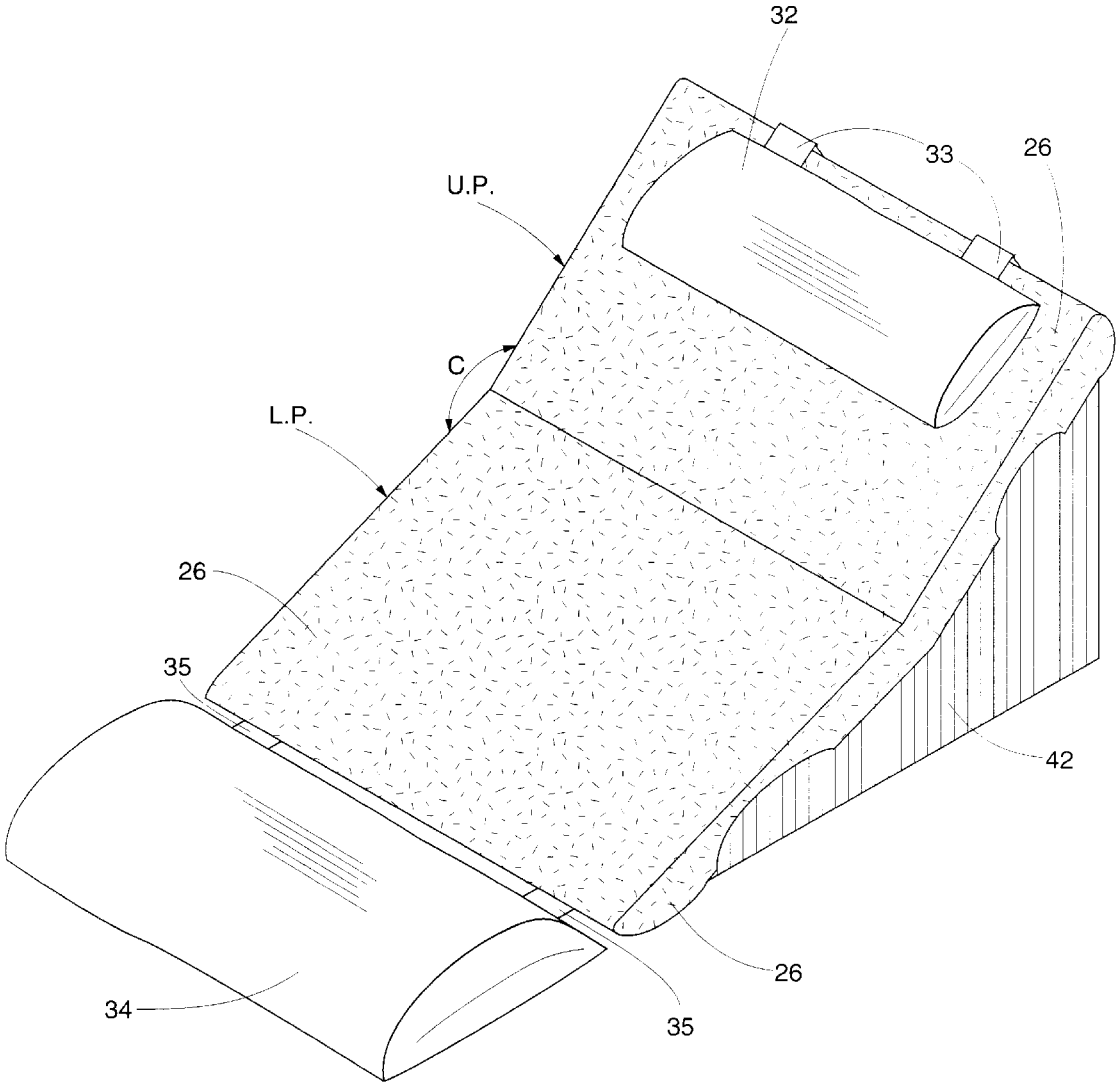
FIG. 2B is an isometric view of the embodiment shown in FIG. 2A but showing the main cushion normally.

Another way to make an embodiment similar to the one shown in FIG. 2B is to make both a generally wedge shaped foundation and top cushion out of a relatively soft foam material but use firm internal support members to provide the equivalent of a relatively firm foundation. The generally wedge shaped foundation and top cushion would be of about the same size and shape as those shown in the embodiment in FIG. 2B, except there would be no lumbar support contours 44 like those shown in FIG. 2A. The soft wedge shaped foundation and top cushion could be made in one piece or made of two pieces in a manner similar to that shown for FIGS. 2A through 2C. To provide lumbar supports, cavities or hollows would be made in the generally wedge shaped foundation and top cushion, and a relatively firm generally cylindrical, generally semi-cylindrical, or other shaped insert would be inserted therein according to the methods described in my previous patent applications contained herein by reference. The cavities or hollows and the firm internal support members would be placed at the position where each of the lumbar supports 44 in FIG. 2A are placed. The embodiment made after using the procedures described would have the effect of providing a relatively firm generally wedge shaped foundation, a softer top cushion, and a means for supporting occupant's lumbar region in a relatively natural lordotic curve, and is to be considered as such for the purposes of the claims.

FIG. 2B is an isometric view of the embodiment shown in FIG. 2A, but showing the main cushion 26 normally. In a presently preferred embodiment, the lower portion L.P. when measured from the bottom edge near the seat cushion 34 to the obtuse angle C is between about 16 inches and about 18 inches. Also, in the same preferred embodiment, the upper portion U.P. when measured from the obtuse angle C to the top edge near the head pillow 32 is between about 18 inches and about 20 inches—though there can be some variance based user height or preference.

Figure 2C:
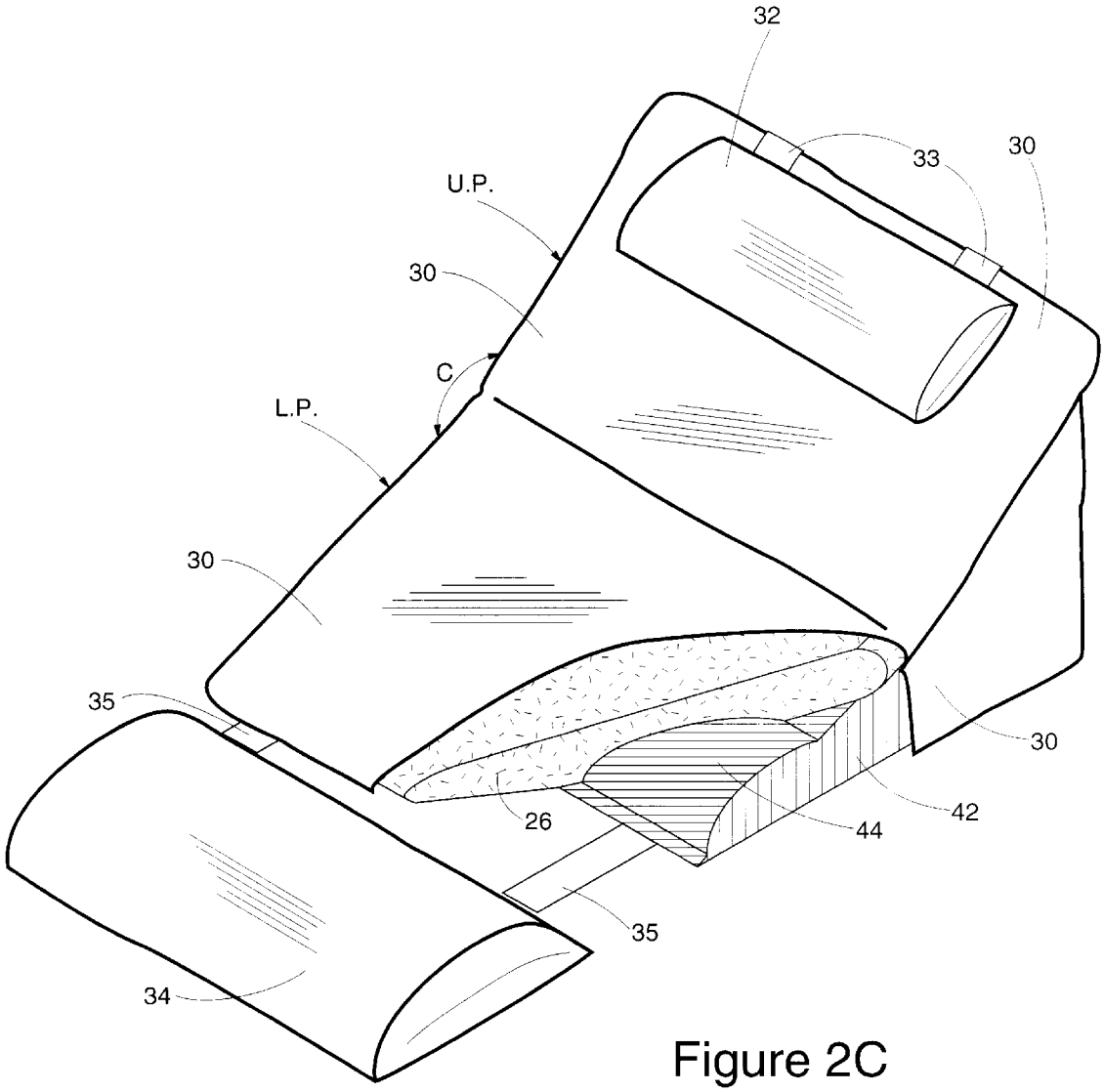
FIG. 2C is anisometric view of the embodiment shown in FIGS. 2A and 2B with a cutaway showing the support foundation, main cushion, and upholstery.

FIG. 2C is an isometric view of the embodiment shown in FIGS. 2A and 2B with a cutaway showing the support foundation 42, main cushion 26, and upholstery 30. The cutaway shows how a lumbar support 44 and the main cushion 26 are shaped to fit with each other. The main cushion 26 has a hollow or recess that corresponds to each of the firmer generally semi-elliptically shaped cylindrical contours that are the lumbar supports 44, and of course the main cushion 26 is placed over the support foundation 42. The main cushion 26 is attached to the support foundation 42 with a glue suitable for polyurethane foam or the like. The upholstery 30 is secured around the support foundation 42 and of course around the main cushion 26.

Figure 2D:
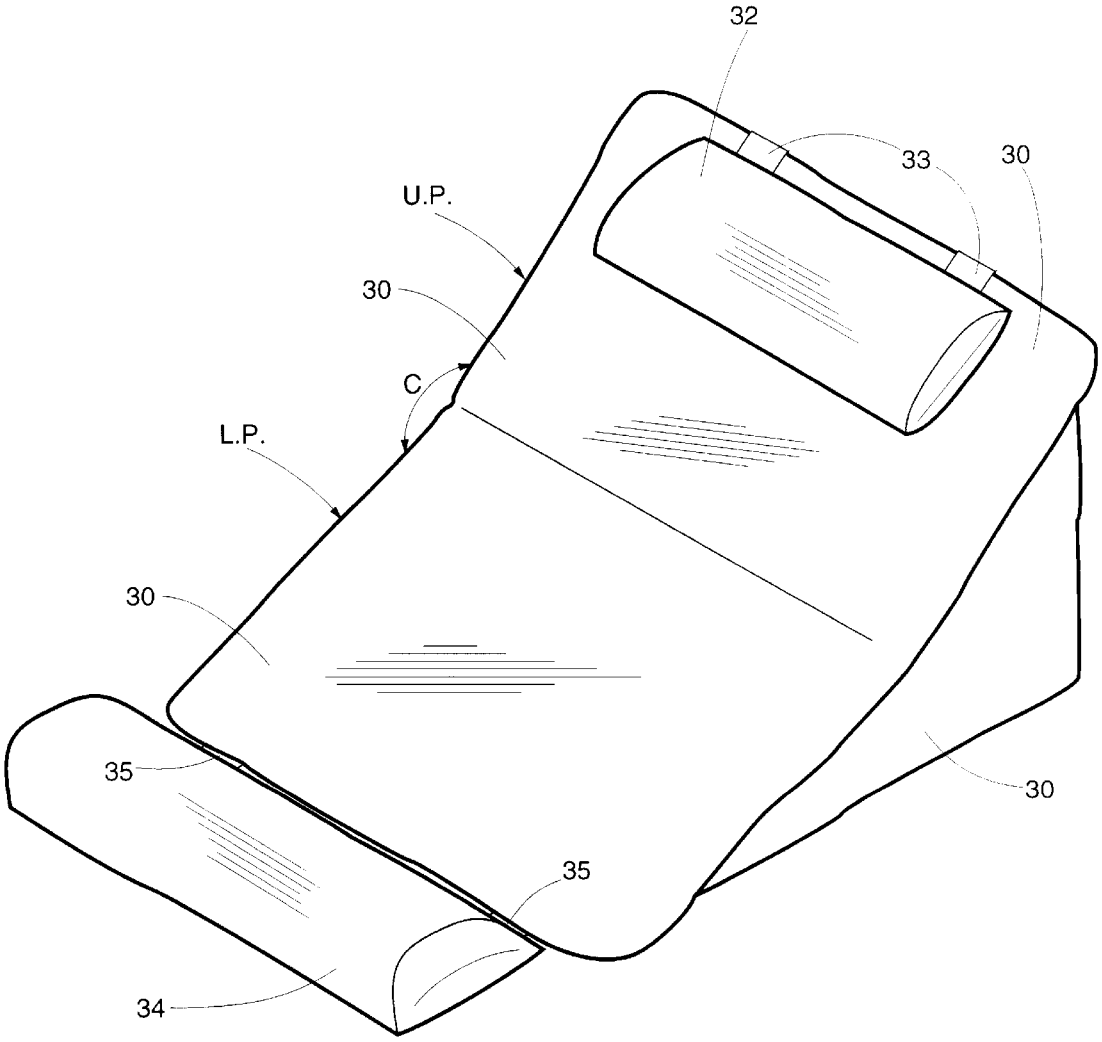
FIG. 2D is an isometric view of the embodiment shown in FIGS. 2A, 2B, and 2C with upholstery.

FIG. 2D is an isometric view of the embodiment shown in FIGS. 2A, 2B, and 2C with upholstery.

Figure 2E:
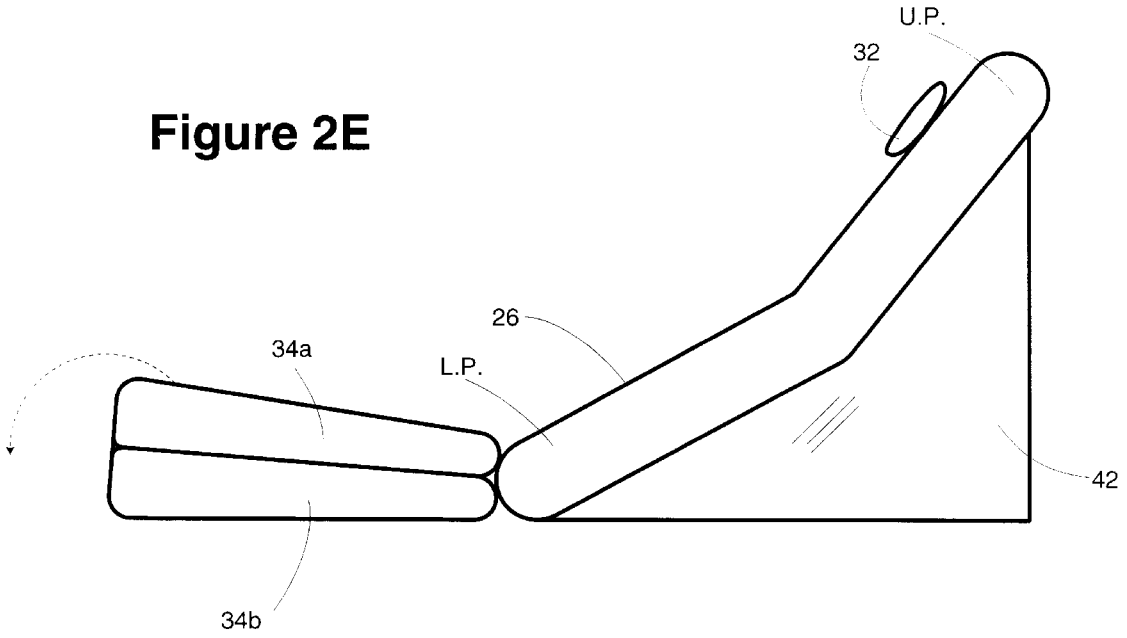
FIG. 2E is a side view of the embodiment shown in FIGS. 2A–2D, but with an alternative seat system.

FIG. 2E is a side view of the embodiment shown in FIGS. 2A–2D, but with an alternative seat system.

Figure 2F:
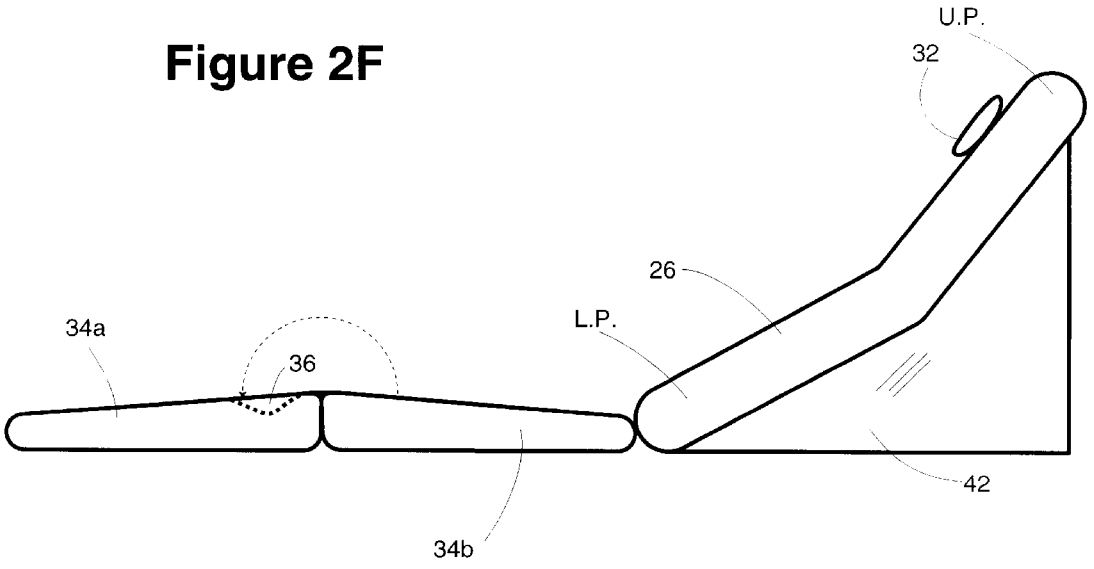
FIG. 2F is a side view of the embodiment shown in FIG. 2E, but with the alternative seat system in the extended position.

FIG. 2F is a side view of the embodiment shown in FIG. 2E, but with the alternative seat system in the extended position. Note: Though this seating system is shown in two pieces 34*a* and 34*b*, it can certainly also be made of one piece that is not foldable. Note that an optional depression 36 is shown in the calf portion of the seat and legrest cushion 34 to serve as a foot support.

Figure 3A:
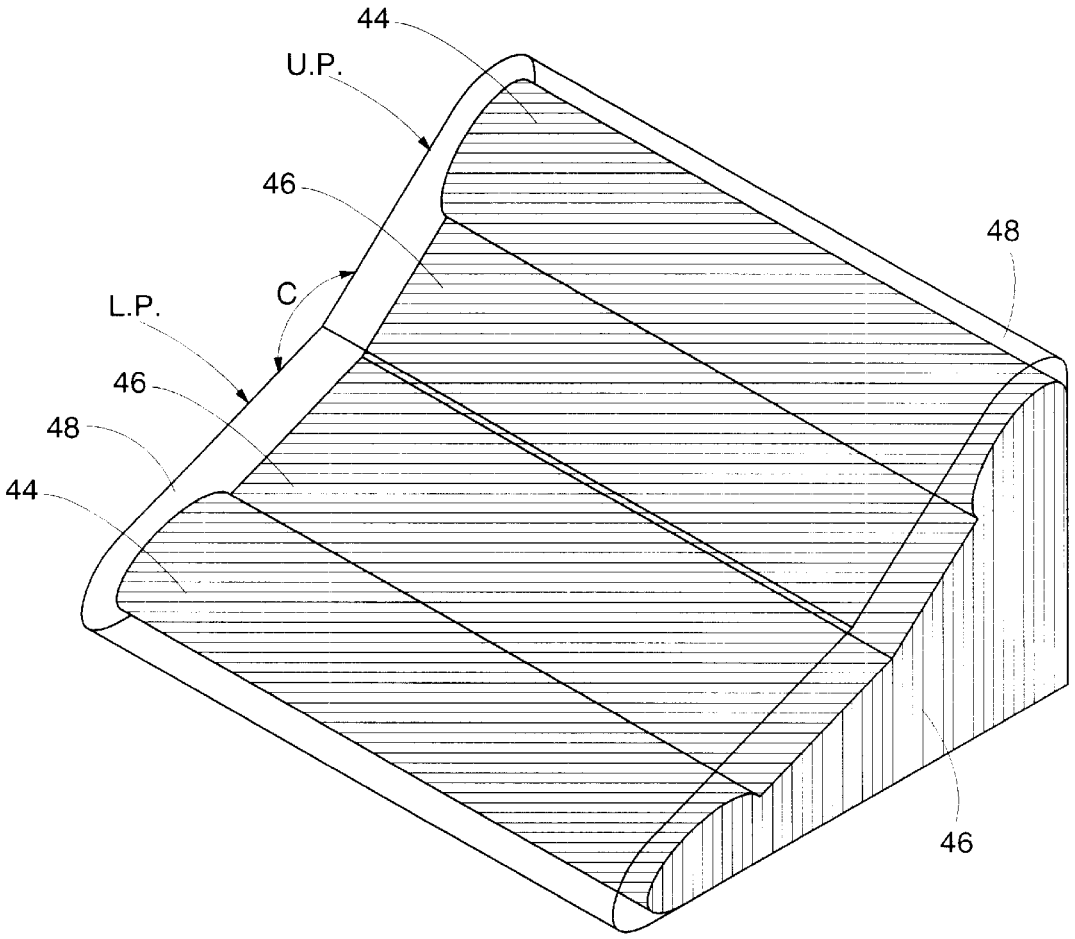
FIG. 3A is an isometric view of an embodiment using a high firmness support foundation for use in a bed or sofa. In this view the main cushion is shown clear to show the support foundation.

FIG. 3A is an isometric view of an embodiment of the present invention using a generally wedge shaped high firmness foundation for use in bed or on a sofa. In this view, the main cushion 48 is shown clear to show the high firmness support foundation 46. In the drawing, the high firmness support foundation 46 is made of a material such as styrofoam or flexible polyurethane foam with an ILD of about 50 or 60 pounds. If the foundation 46 is made of styrofoam, it would probably be shaped in an injection type mold, whereas if the foundation 46 was made of flexible polyurethane foam it could either be formed in a mold, or cut and shaped out of a large piece of slab cushion material with a band saw or the like. The foundation 46 is similar to the firm foundation 42 shown in FIGS. 2A, 2B, and 2C, except it is a bit smaller, and the lumbar supports 44 start at or near the top and bottom edges. The reason the high firmness support 46 and the main cushion 48 shown in FIG. 3A are smaller than their counterparts the high firmness support foundation 42 and the main cushion 26 in FIG. 2A is that a person sitting on a bed or sofa will sink a few inches into the bed or sofa. When the person's body sinks down into the sofa or mattress, that means that there is less of the person's lower back left to support, because some of the person's back is now below the level of the backrest. Also, since the person sinks into the mattress or sofa, the need for a seat cushion like 34 on FIG. 2C to keep the user from slipping down is greatly reduced—especially with a good mattress with independent springs. This is because the natural give of a bed or sofa provides a natural seat cushion, and since most of the weight is focussed on the point where the buttocks meet the mattress, the user will sink into the mattress in a way that will prevent slipping down—eliminating the need for a seat cushion. One other possible difference between the high firmness support foundation 46 and the high firmness support foundation 42 shown in FIG. 2A is that it would probably only be appropriate to make the support foundation out of a softer lighter material such as flexible polyurethane foam or styrofoam, since it will be desirable to put it on a bed or sofa. Materials such as plywood or fiberglass are so hard that few people would want to put it on a bed or sofa. There would also be a safety concern with a backrest made to be used above the floor, if it were made of a heavier or harder material. If such a backrest fell on someone, it could cause injury, especially if it were to fall on a small child.

There are two other ways to make a high firmness support foundation and the backrest of this type of embodiment. Both methods involve having an internal high firmness member or members. The first method requires a mold for doing injection molding of the soft foam over the firm internal support foundation. The mold would be about the same size and shape as the foundation 46 with the soft top cushion 48 over it shown in FIG. 3A or FIG. 3B. A firm foundation of a similar size and shape as shown in FIG. 3A, except with about 1" (could more than 1" if desired) trimmed off on the back, the bottom, and each of the two sides, would be put into the mold. This firm foundation would be held in place in the mold so that the back, the bottom, and each of the two sides would be about 1" away from the back, the bottom, and each of the two sides of the mold. The mold would be sealed closed, and a flexible foam material would be injected into the mold so that the finished product would be about the same size and shape of the foundation 46 with the soft top cushion 48 over it shown in FIG. 3B. The result would be a molded one piece generally wedge shaped foundation with soft top cushion which also has the bottom, the back, and each of the two sides cushioned with the soft cushion material.

Figure 3B:
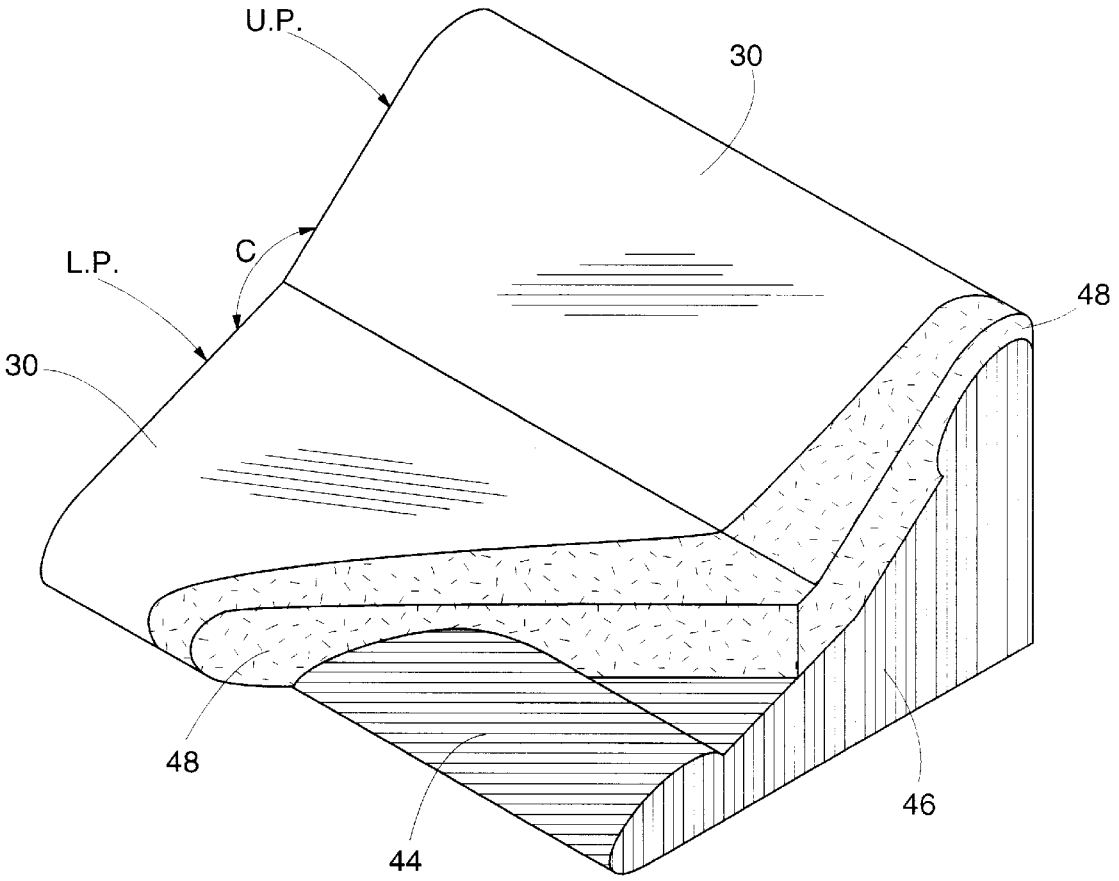
FIG. 3B is an isometric view of the embodiment shown in FIG. 3A with a cutaway showing the foundation and the main cushion.

Another way to make an embodiment similar to the one shown in FIG. 3B is to make both a generally wedge shaped foundation and top cushion out of a relatively soft foam material but use firm internal support members to provide the equivalent of a relatively firm foundation. The generally wedge shaped foundation and top cushion would be of about the same size and shape as those shown in the embodiment in FIG. 3B, except there would be no lumbar support contours 44 like those shown in FIG. 3A. The soft wedge shaped foundation and top cushion could be made in one piece or made of two pieces in a manner similar to that shown for FIGS. 3A and 3B. If made in one piece, it could be cut out of a piece of slab foam material with a band saw or other type of cutting tool used in the foam industry. To provide lumbar supports, cavities or hollows would be made in the generally wedge shaped foundation and top cushion, and a relatively firm generally cylindrical, generally semi-cylindrical or other shaped insert would be inserted therein according to the methods described in my previous patent applications. The cavities or hollows and the firm internal support members would be placed at the position where each of the lumbar supports 44 in FIG. 3A are placed. The embodiment made after using the procedures described would have the effect of providing a relatively firm generally wedge shaped foundation, a softer top cushion, and a means for supporting occupant's lumbar region in a relatively natural lordotic curve, and is to be considered as such for the purposes of the claims.

FIG. 3B is an isometric view of the embodiment shown in FIG. 3A with a cutaway showing the support foundation 46, the main cushion 48, and upholstery 30. The main cushion 48 is made of relatively soft material such as flexible polyurethane foam with an ILD of about 20 pounds. The drawing shows how the main cushion 48 is shaped to fit over the lumbar supports 44 on the high firmness support foundation 46. The main cushion 48 would be glued to the support foundation 46 with a glue suitable for polyurethane foam or the like. The main cushion 48 has a hollow or recess that corresponds to each of the firmer generally semi-elliptically shaped cylindrical contours that are the lumbar supports 44, and of course the main cushion 48 is placed over the support foundation 46. In a preferred embodiment, the lower portion L.P. of the main cushion 48 is between about 12 inches and about 14 inches when measured from the bottom or front edge to the obtuse angle C. The obtuse angle C is between about 160 degrees and about 170 degrees and in a preferred embodiment is about 165 degrees. The upper portion U.P. is about the same size as the lower portion L.P. The backrest shown is dual position, and so it has contoured lumbar supports 44 on the high firmness support foundation 46. The slope of the lower portion L.P. of a preferred embodiment of the backrest is about 30 degrees. This means that the slope of the upper portion U.P. of the backrest is about 45 degrees. When the backrest is put in the alternate or upright position (the back becomes the bottom, and the bottom becomes the back), the slope of what will now become the lower portion L.P. (formerly the upper portion U.P.) will be about 45 degrees, while the upper portion U.P. (formerly the lower portion) will be about 60 degrees. Though the backrest is shown as dual position, it can of course be made for use in a single position. To make it for use in a single position, only one lumbar support would be required, and it would probably be desirable to make the slope of the lower portion L.P. between 30 degrees and 45 degrees.

Figure 3C:
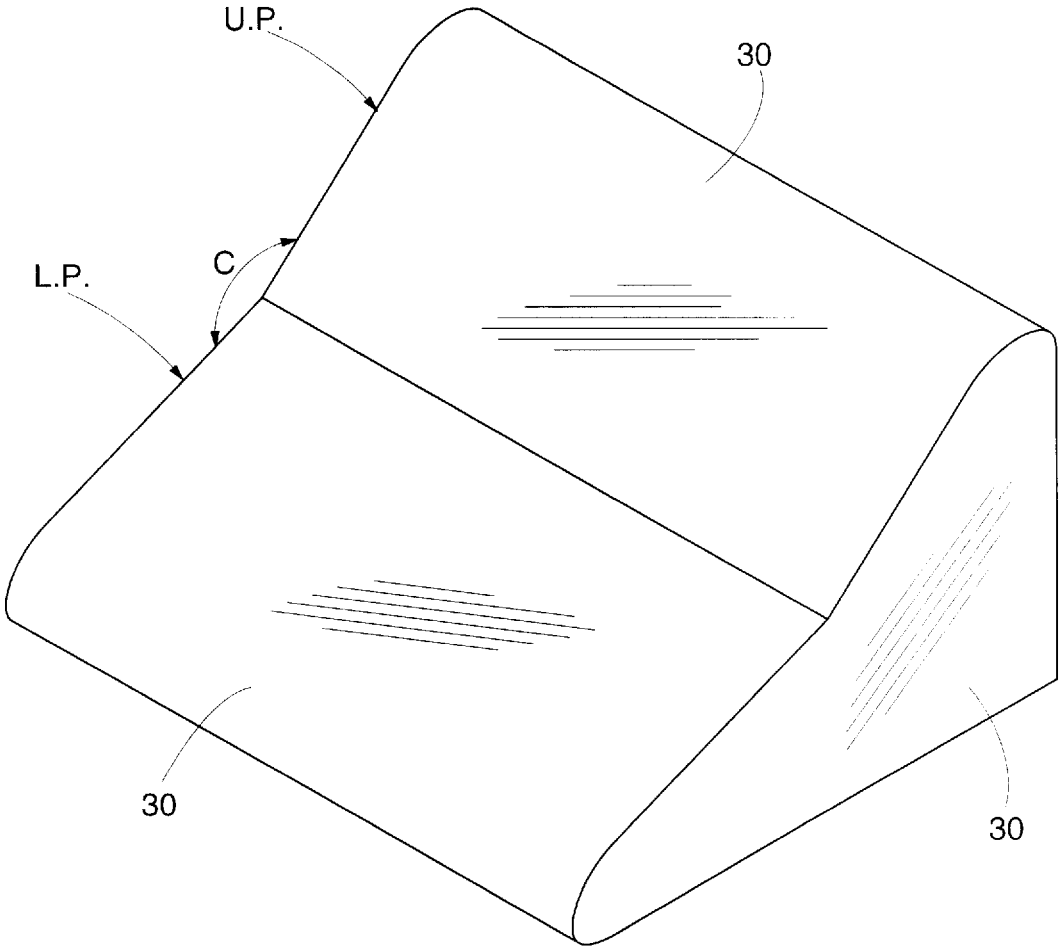
FIG. 3C is an isometric view of the embodiment shown in FIGS. 3A and 3B with support foundation, main cushion and upholstery.

FIG. 3C is an isometric view of the embodiment shown in FIGS. 3A and 3B with finished upholstery 30. It should be noted that there is no attached head pillow with this. The reason for this is that a user can supply their own pillow, especially when the backrest is used in bed or on a sofa. Though a head pillow could be attached, it does not seem to be essential, and the additional bulk a head pillow adds does not seem to justify the convenience provided when a person already has a pillow in bed or on a sofa.

Figure 4A:
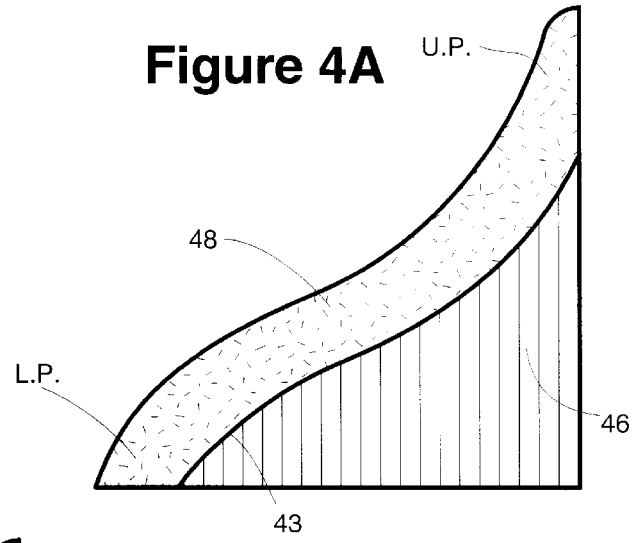
FIG. 4A is a side view of an embodiment of the present invention with the foundation and top cushion contoured to provide lumbar support for use in a bed or sofa.

FIG. 4A is a side view of a generally wedge shaped embodiment of the present invention similar to the one described in FIGS. 3A–3C, but with the top cushion 48 and foundation 46 contoured to provide a lumbar support. FIG. 4A has a convex contour 43 on the lower portion L.P. on both the cushion and foundation to provide the lower back support without the internal lumbar support. The convex contour 43 is designed to support the lumbar region of the user's back in a relatively natural lordotic curve. The embodiment in FIG. 4A is for use in a bed or sofa and uses the same principles of construction as were described for FIGS. 1A–1C and further using the principles described in FIGS. 3A–3C with regards to positioning of the lumbar support 43 and use. Unlike the embodiment shown in FIG. 3, this embodiment is only shown for single position use.

Figure 4B:
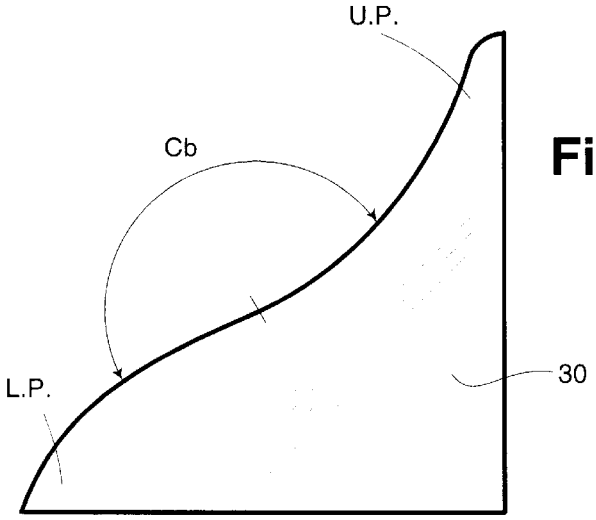
FIG. 4B is a side view of the embodiment shown in FIG. 4A, but shown with upholstery.

FIG. 4B is a side view of the embodiment shown in FIG. 4A, but shown with upholstery 30. In the drawing, there is an obtuse angle bend Cb between the upper portion U.P. and the lower portion L.P. which results in the average general pitch of the sloped face on the lower portion L.P. being at a lower angle relative to a horizontal plane such as a bed than the upper portion U.P.

Figure 4C:
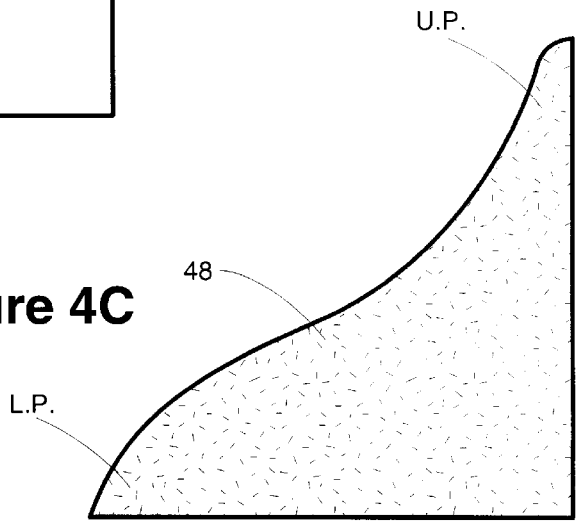
FIG. 4C is a side view of the embodiment shown in FIGS. 4A and 4B, but shown with the foundation and top cushion made out of only one material.

FIG. 4C is a side view of the embodiment shown in FIGS. 4A and 4B, but shown with the foundation and top cushion made out of only one material 4C. This simply shows how the embodiment described in FIG. 4A can be made using principles similar to those described for FIG. 1E.

Figure 5:
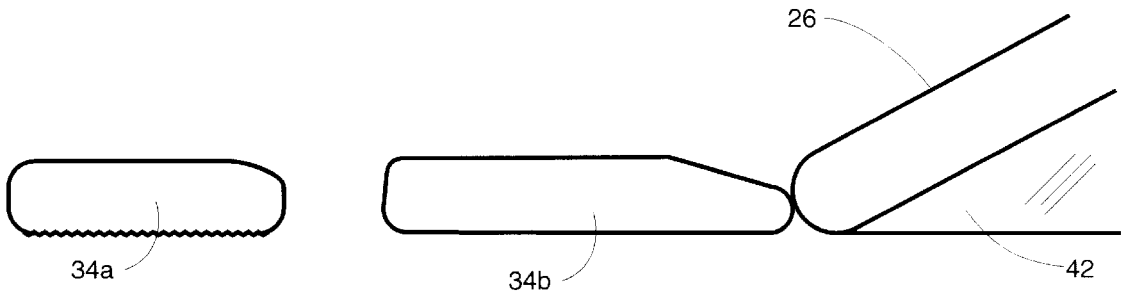
FIG. 5 is a view of an alternative seat and legrest system.

FIG. 5 is an alternative seat cushion 34*b* and an alternative legrest system 34*a* that could be used on the embodiments shown in FIGS. 1 and 2, as well as most of the legless leisure chairs described in my other patent applications. In the drawing, part of the seat cushion 34*b* is placed under the main backrest cushion 26 as shown. The seat cushion 34*b* could be made by putting a suitably sized and shaped cushion into an upholstery "bag" generally similar in construction to the way a pillowcase is made, but the upholstery bag would have about 6" of material extending at the open end beyond the cushion, for attaching to the foundation or frame of a legless leisure chair. This type of construction could be simpler than attaching straps, as well as somewhat more secure. The legrest portion 34*a* would be made of a cushion material upholstered, and having a generally flat top and bottom, having about the same width (side to side measurement) as the seat cushion 34*b,* a front to back measurement of about 10" to 18", and a height generally similar to the height of the seat cushion 34*b*. The top of the legrest cushion 34*a* could be pitched somewhat from front to back. The edge facing the main cushion 26 (which would be the back edge) can be shaped to accommodate the arches an occupant's feet while the top is shaped to accommodate the occupant's calves. The bottom of the upholstered legrest cushion 34*a* should be made in a manner that would prevent it from moving away from the main backrest cushion 26. This can be accomplished in a number of ways, in the case of a velvet material, the pile can be made to run in the direction that would make it catch on a carpet and keep it from moving away from the backrest cushion 26. Other solutions would include using material having a number of prongs on it such as the scratchy side of velcro type material. For use of a hard surface floor, a rubber or other non skid type material would be suitable, and also, a number of suction cups could be used. This type of seat and legrest system has the advantage of being adjustable, simple to manufacture, and makes it very convenient to make the chair compact when not in use by just putting the legrest portion 34*a* on the seat cushion 34*b*. While in a preferred embodiment, the seat cushion 34*b* is not in any way attached to the legrest cushion 34*a,* it certainly could be if desired with straps, strings or a similar attachment means.

CONCLUSIONS, RAMIFICATIONS, AND SCOPE OF INVENTION

Thus the reader will see that the leisure chairs and backrests of this invention are economical, attractive, useful, compact, and very comfortable for sitting or reclining.

Although my above description contains many specificities, these should not be construed as limiting the scope of the invention, but merely as providing illustrations of the presently preferred embodiments of this invention. Many other variations are possible. This invention can be made a number of ways, with a wide variety of materials, it can be made with a number of accessories as part of it or to used be with it, and the principles of this invention can be applied to a number of other uses.

It is known in the industry that people have different preferences when it comes to comfort, and while the descriptions of firmness, shapes, and sizes described in this application are specific, for many people variations would be preferred. Guidelines for making chairs such as those described herein for various groups of people and their preferences are available in the industry through such resources as HumanScale and ANSI standards. For example, the dual position leisure chairs or backrests can instead be made single position at an angle that would be some happy medium between those shown and described. Also, there are alternative ways of providing the lumbar supports on chairs such as having the center (with respect to the sides) of the lumbar curve or support on the firm foundation being of a softer material to reduce stress on the spine.

The backrests/leisure chairs can be made for multiple users like a love seat by making it wider, can be made in children's sizes, and can be made in tall sizes. The look of the leisure chairs can be changed drastically making them with styles similar to those used on wide variety of typical upholstered armchairs. It is also possible that another high firmness cushion insert could be placed behind the shoulder area as well as the lumbar region to assist in orienting the upper body. The support surface can be made somewhat concave from the left side to the right side to correspond with the shape of the chest/abdomen etc. of the human body. And though the backrests/leisure chairs are more comfortable with the lumbar supports described, for more economical backrests/leisure chairs, an ordinary cushion without any means for providing a specific lumbar support can be used for the main cushion, and could be placed over a flat foundation. Other embodiments can be made using inflatable materials such as inflatable cushions, with a head pillow as an integral part of the upper portion, or could be made in a manner similar to the way automobile seats are made, with a process where the slope frame is put in a mold and a cushion is injection molded around the foundation or frame. And it is not necessary that the head pillow be attached.

The backrests/leisure chairs can be made of a great variety of materials. The foundation can be made of polyurethane foam, polyester foam, styrofoam or other foam, plywood, particle board, plastic, fiberglass, etc. The cushions including the top cushion 26, seat cushions 34 and head pillow 32 can be made of a variety of materials including cotton, feathers, polyurethane foam, soft polyester fill, dacron fill, shredded foam, and other relatively materials either known or to be known in the industry. The upholstery can be made of fabric, vinyl, leather, etc.

Other methods, materials, and techniques that can be applied to making backrests and leisure chairs of this invention are known or will be known in the industry relating to this invention.

The backrests/leisure chairs of this invention are suitable for being used with a number of accessories. One such accessory is a work surface such as a desk top adapted for use with the chair. Also, a specially designed type of ottoman or legrest can be used with the backrest/leisure chair. The area under the slope can be designed to hold a storage compartment for books or something similar. Since the backrest/leisure chair is near the floor, special lights for reading may be desired. It is also possible to attach a device to hold a book, using principles similar to those used in the type of lamps used by draftsmen. Additionally, a chair with a support foundation could have armrests.

The principles of this invention can be applied to futon designs, to chaise type lounges or other type lounges.

Though it presently seems preferable to make the leisure chair with a softer top cushion, for embodiments such as FIGS. 1 and 4, it is quite possible to make the top cushion of the same firmness, or possibly even slightly more firm than the foundation, if the foundation was not especially firm. Also, for aesthetic reasons, the top cushion can be the same size, larger, or smaller than the face of the foundation, and can also be of different thicknesses.

The seating systems shown in various embodiments are interchangeable among the embodiments, for example the seating system shown in FIGS. 2E and 2F could be used for the embodiment in FIG. 1A, likewise the seating system used in FIG. 1D could be interchanged with the seating system shown in FIGS. 2E, 2F, and 5, etc. Further the seating system shown suggests other possibilities as well, for example the seating systems shown in FIGS. 1D and 2F could be made with out the 34*a* portion. And the seat attachment means can vary. Additionally, the seating systems shown in FIGS. 1D, 2E, 2F and 5 could quite suitably be used on other chairs such as those described in my previous applications.

Design, methods of construction, details and methods of manufacture are interchangeable between embodiments.

Accordingly, the scope of the invention should be determined not by the embodiments illustrated, described, and measurements, but by the appended claims and their legal equivalents.

I claim:

1. A backrest/leisure chair comprising:

(a) a relatively firm generally wedge shaped foundation having a sloped face, a base, a back and two sides, the face being oriented at an acute angle from the base to define a generally wedge shape, the face further having an obtuse angle generally at its midpoint which orients an upper portion of the face at a higher angle than a lower portion;

(b) a softer top cushion having an upper and lower portion secured to the face; and (c) a means for supporting occupant's lumbar region in a relatively natural lordotic curve comprising a generally convex semi-elliptically shaped elongated cylindrical generally firm lumbar support on the lower portion of the relatively firm foundation and extending substantially to a lower edge of said face, said firm lumbar support having a firmness sufficient to generally maintain its convex shape when pressure from a reclining occupant leaning against the foundation is applied.

2. The backrest/leisure chair of claim 1 wherein said means for supporting a natural lumbar lordotic curve is a relatively firm generally semi-elliptically shaped cylindrical contour on the foundation, with the softer top cushion having a hollow that corresponds to the semi-elliptically shaped contour, placed over the foundation.

3. The backrest/leisure chair of claim 1 wherein said generally wedge shaped foundation has a convex contour on the lower portion of said face for supporting the lumbar curve of the user in a relatively natural lordotic curve, when a top cushion of is placed over it, and wherein the top cushion generally follows the convex contour of the foundation.

4. The backrest/leisure chair of claim 1 wherein the generally midpoint on the face has a means for cradling the middle range of the occupant's thoracic vertebrae.

5. The backrest/leisure chair of claim 1 wherein said obtuse angle is between about 160 degrees and about 170 degrees.

6. The backrest/leisure chair of claim 1 wherein the acute angle of the lower portion of the generally wedge shaped foundation relative to a horizontal plane is between about 20 degrees and about 70 degrees.

7. The backrest/leisure chair of claim 1 further including a seat cushion having an attachment means secured to the lower portion of the foundation, suitable for providing comfort to the buttocks when sitting on the floor, and at the same time preventing the occupant of said leisure chair from slipping down out of position.

8. The backrest/leisure chair of claim 7 further including an unattached legrest cushion for supporting the lower legs of the user, and having a generally slip resistant surface on the bottom of its upholstery.

9. The backrest/leisure chair of claim 1 wherein a pillow is provided for a head rest, and wherein the pillow has an attachment means to secure it near the top of the generally wedge shaped foundation.

10. A backrest/leisure chair comprising:

(a) a relatively firm generally wedge shaped foundation having a face, a base, a back and two generally triangular sides, with the base being positioned parallel to a horizontal plane such as a floor or bed, and the face being oriented at an acute angle relative to both the base and the horizontal plane to define a generally wedge shape, wherein said face has an upper portion and a lower portion, wherein said upper portion has an average general pitch relative to the horizontal plane and said lower portion has an average general pitch relative to the horizontal plane, and wherein said face further has a contour which orients the average general pitch of upper portion of the face at a greater incline than the average general pitch of the lower portion;

(b) a means for supporting occupant's lumbar region in a relatively natural lordotic curve comprising a generally convex semi-elliptically shaped elongated cylindrical generally firm lumbar support on the lower portion of the relatively firm foundation and extending substantially to a lower edge of said face, said firm lumbar support having a firmness sufficient to generally maintain its convex shape when pressure from a reclining occupant leaning against the foundation is applied; and (c) a top cushion having an upper and lower portion secured to the face of the generally wedge shaped foundation.

11. The backrest/leisure chair of claim 10 wherein the top cushion is integral and continuous with the generally wedge shaped foundation.

12. The backrest/leisure chair of claim 10 wherein the firm foundation has an ILD firmness of at least 30 pounds.

13. The backrest/leisure chair of claim 10 wherein the top cushion has an ILD firmness of less than 41 pounds.

14. The backrest/leisure chair of claim 10 wherein said means for supporting a natural lumbar lordotic curve is a relatively firm generally semi-elliptically shaped cylindrical contour on the foundation, with the softer top cushion having a hollow that corresponds to the semi-elliptically shaped contour, placed over the foundation.

15. The backrest/leisure chair of claim 10 wherein said generally wedge shaped foundation has a convex contour on the lower portion of said face for supporting the lumbar curve of the user in a relatively natural lordotic curve, when a top cushion of is placed over it, and wherein the top cushion generally follows the convex contour of the foundation.

16. The backrest/leisure chair of claim 10 wherein the generally midpoint on the face has a means for cradling the middle range of the occupant's thoracic vertebrae.

17. The backrest/leisure chair of claim 10, wherein an obtuse angle is formed by the intersection of the average general pitch of the lower portion and the average general pitch of the upper portion, and wherein said obtuse angle is between about 160 degrees and 170 degrees.

18. The backrest/leisure chair of claim 10 further including a seat cushion having an attachment means secured to the lower portion of the foundation, suitable for providing comfort to the buttocks when sitting on the floor, and at the same time preventing the occupant of said leisure chair from slipping down out of position.

19. The backrest/leisure chair of claim 10 further including an unattached legrest cushion for supporting the lower legs of the user, and having a generally slip resistant surface on the bottom of its upholstery.

20. The backrest/leisure chair of claim 10 wherein a pillow is provided for a head rest, and wherein the pillow has an attachment means to secure it near the top of the generally wedge shaped foundation.

21. A backrest/leisure chair comprising:

(a) a generally wedge shaped support foundation having an inclined face, said face comprising an upper portion and a lower portion, with the lower portion of the face being oriented at an acute angle relative to a horizontal plane such as a floor or bed, said upper portion further having an average general pitch relative to the horizontal plane and said lower portion having an average general pitch relative to the horizontal plane, said inclined face further having a valley generally in the area where the upper portion and lower portion meet resulting in the average general pitch of upper portion of the face being at a greater incline relative to the horizontal plane than the average general pitch of the lower portion relative to the horizontal plane, wherein said valley provides a means for cradling an occupant's throracic curve, said support foundation further having a convex contour on the lower portion of said face for supporting an occupant's lumbar region in a relatively natural lordotic curve, said convex contour being generally uniform in cross sectional shape like a generally semi-elliptically shaped elongated cylinder which extends substantially to a lower edge of said inclined face, said convex contour further having a firmness sufficient to generally maintain its convex shape when pressure from a reclining occupant leaning against the foundation is applied; and (b) a top cushion having an upper and lower portion secured to the face of said generally wedge shaped foundation.

* * * * *

US005836653C1

(12) EX PARTE REEXAMINATION CERTIFICATE (7253rd)

United States Patent

Albecker

(10) Number: US 5,836,653 C1

(45) Certificate Issued: Dec. 22, 2009

(54) BACKRESTS/LEGLESS LEISURE CHAIRS MADE WITH A FOUNDATION

(76) Inventor: Walter J. Albecker, 838 S. May, Chicago, IL (US) 60607

Reexamination Request:
No. 90/010,398, Apr. 1, 2009

Reexamination Certificate for:

| | |
|---|---|
| Patent No.: | **5,836,653** |
| Issued: | **Nov. 17, 1998** |
| Appl. No.: | **08/492,170** |
| Filed: | **Jun. 19, 1995** |

Related U.S. Application Data

(63) Continuation-in-part of application No. 07/899,750, filed on Jun. 17, 1992, now Pat. No. 5,425,567, and a continuation-in-part of application No. 07/721,179, filed on Jun. 26, 1991, now abandoned, and a continuation of application No. 08/197,223, filed on Feb. 16, 1994, now Pat. No. 5,474,362.

(51) Int. Cl.
*A47C 20/00* (2006.01)

(52) U.S. Cl. ..... 297/452.31; 297/452.16; 297/452.32; 5/632; 5/633

(58) Field of Classification Search ..... None
See application file for complete search history.

(56) References Cited

U.S. PATENT DOCUMENTS

| | | | | |
|---|---|---|---|---|
| 3,361,471 | A | 1/1968 | Radford | 297/230 |
| 3,555,582 | A | 1/1971 | Raford | 5/338 |
| D259,381 | S | 6/1981 | Smith | D6/200 |
| D274,576 | S | 7/1984 | Tiffany | D6/335 |
| 4,473,913 | A | 10/1984 | Ylvisaker | 5/435 |
| 4,712,833 | A | 12/1987 | Swanson | 297/219 |
| 4,752,293 | A | 6/1988 | Smith | 604/322 |
| D334,107 | S | 3/1993 | Johnson | D6/601 |

FOREIGN PATENT DOCUMENTS

| | | |
|---|---|---|
| DE | 1654298 | 5/1967 |
| DE | 2834947 | 7/1978 |

*Primary Examiner*—Jeanne M. Clark

(57) ABSTRACT

A number of generally wedge shaped backrests and legless leisure chairs for sitting on the floor or on a bed, which orient the user's upper back at a higher angle than the user's lower back. These are ideally suited for people who want to be in a reclining type position, but yet want to do something like watch television. The backrests/leisure chairs disclosed use a support foundation (42 and 46). The backrests/leisure chairs described also have a way of maintaining the lumbar region of the user's back in a relatively natural lordotic curve, some through a high firmness lumbar support member (28) on the support foundation (42 and 46) placed in a hollow in the back of the main cushion (26), and others through making a convex contour on the lower portion of the backrest/leisure chair. All of the leisure chairs for sitting on the floor have a seat cushion (34) to prevent the user from slipping down out of place and these chairs can also have a pillow (32) for a headrest. Also disclosed are a member of seat cushion and legrest alternatives (34) for the leisure chairs including folding seat cushions and a two piece seat and legrest cushion system.

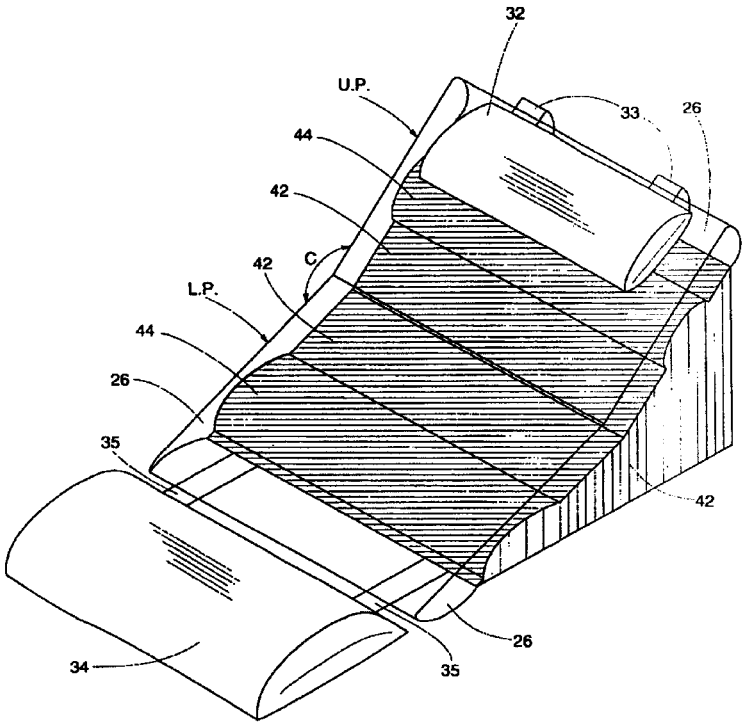

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–21 is confirmed.

* * * * *